US007698845B2

(12) United States Patent
Hochstrate et al.

(10) Patent No.: US 7,698,845 B2
(45) Date of Patent: Apr. 20, 2010

(54) DOUBLE ACTION MODEL 1911 PISTOL

(75) Inventors: Paul Hochstrate, Plantsville, CT (US); Arthur Daigle, Plymouth, CT (US)

(73) Assignee: New Colt Holding Corporation, Hartford, CT (US)

( * ) Notice: Subject to any disclaimer, the term of this patent is extended or adjusted under 35 U.S.C. 154(b) by 941 days.

(21) Appl. No.: 11/305,391

(22) Filed: Dec. 16, 2005

(65) Prior Publication Data

US 2006/0150466 A1 Jul. 13, 2006

Related U.S. Application Data

(60) Provisional application No. 60/636,841, filed on Dec. 16, 2004.

(51) Int. Cl.
*F41A 3/00* (2006.01)

(52) U.S. Cl. ..... 42/69.03; 42/69.01

(58) Field of Classification Search ..... 42/69.01, 42/69.03; 89/132, 139, 147, 194–197
See application file for complete search history.

(56) References Cited

U.S. PATENT DOCUMENTS

| | | | | |
|---|---|---|---|---|
| 954,904 | A | 4/1910 | White | |
| 1,440,332 | A | 12/1922 | Braunger | |
| 1,896,820 | A | 2/1933 | Jolidon | |
| 2,138,213 | A | 11/1938 | Seidel | 42/4 |
| 3,682,040 | A | 8/1972 | Roy | 89/132 |
| 3,722,358 | A * | 3/1973 | Seecamp | 89/147 |
| 4,028,836 | A | 6/1977 | Keppeler | 42/69 B |
| 4,275,640 | A | 6/1981 | Wilhelm | 89/147 |
| 4,321,764 | A | 3/1982 | Wilhelm | 42/69 B |
| 4,555,861 | A | 12/1985 | Khoury | 42/70 |
| 4,955,155 | A * | 9/1990 | Jones | 42/69.01 |
| 5,000,075 | A | 3/1991 | Tuma | 89/147 |
| 5,160,796 | A | 11/1992 | Tuma et al. | 42/69.03 |
| 5,216,195 | A | 6/1993 | Tuma | 89/147 |
| 5,400,537 | A | 3/1995 | Meller et al. | 42/69.03 |
| 5,426,880 | A | 6/1995 | Ruger et al. | 42/69.03 |
| 5,533,291 | A * | 7/1996 | Boland | 42/7 |
| 5,797,206 | A * | 8/1998 | Vitorino | 42/69.03 |
| 5,799,434 | A * | 9/1998 | Krieger et al. | 42/69.03 |
| 5,815,973 | A | 10/1998 | Hochstrate | 84/69.03 |
| 6,000,162 | A | 12/1999 | Hochstrate | 42/69.03 |
| 6,283,006 | B1 | 9/2001 | Szabo et al. | 89/147 |
| 6,381,892 | B1 | 5/2002 | Szabo et al. | 42/70.08 |
| 6,405,631 | B1 * | 6/2002 | Milek | 89/139 |
| 6,415,702 | B1 * | 7/2002 | Szabo et al. | 89/148 |
| 6,557,288 | B2 * | 5/2003 | Szabo | 42/70.01 |
| 7,257,918 | B2 * | 8/2007 | Moore | 42/69.03 |

FOREIGN PATENT DOCUMENTS

FR 898 811 A 5/1945

* cited by examiner

*Primary Examiner*—Michael Carone
*Assistant Examiner*—Jonathan C Weber
(74) *Attorney, Agent, or Firm*—Perman & Green, LLP

(57) ABSTRACT

A model 1911 semi automatic pistol having a receiver, a barrel, a breach slide and a firing mechanism. The barrel is coupled to the receiver. The breach slide coupled to the receiver. The firing mechanism is coupled to the receiver. The firing mechanism is adapted for double action operation. The firing mechanism has a hammer with a firing pin strike surface and an engagement surface enabling single action operation of the firing mechanism. The engagement surface is movable relative to the firing pin strike surface.

15 Claims, 15 Drawing Sheets

DOUBLE ACTION MODEL 1911 PISTOL

This application claims priority from provisional application Ser. No. 60/636,841, filed on Dec. 16, 2004.

BACKGROUND

1. Field

The disclosed embodiments relate to firearms and, more particularly, to a model 1911 pistol capable of double action operation.

2. Description of Earlier Related Developments

Single and double action semi automatic pistols such as the compact pistol disclosed in U.S. Pat. No. 6,000,162 which is hereby incorporated by reference in its entirety have been used broadly. A very popular and prevalent pistol configuration is the model 1911 pistol configuration, such as made by Colt's Manufacturing Corp., and used as a single action semi automatic pistol. In this form, the model 1911 pistol has had broad and extended historical use, bringing the model 1911 world renown that is well deserved. With a slim shape, and historical renown, the model 1911 continues as a highly desired firearm. Further, there is a desire for a model 1911 pistol with the convenience and expedience of double action operation (the capability of cocking the hammer and firing the firearm by actuation of the trigger). Conventional double action firing mechanisms have an arrangement generally illustrated for employment in the model 1911 frame. The slim profile of the model 1911 pistol frame provides little room for inclusion of the firing mechanism for double action operation. One example of a model 1911 pistol capable of double action operation is disclosed in U.S. Pat. No. 3,722,358 wherein conversion of existing (single action only) pistols to double action (for the first shot) is provided by addition of a cocking link between trigger and hammer that is completely separate from the single action mechanism. As may be realized, however, the use of a completely separate cocking link from the mechanism is inefficient and costly to manufacture (employing two separate mechanisms to effect cocking and firing instead of one), and also compromises the mechanical efficiency (the engagement between the cocking link and hammer, in this example, is necessarily close to the pivot pin of the hammer generating little leverage against the mainspring) and operator "feel" when firing the pistol. Other examples of conventional double action pistols, use mostly pistol frames that are wider than the model 1911 pistol. There is a desire to provide a pistol having a model 1911 frame configuration where the pistol is capable of double/single action operation or double action only operation. The exemplary embodiments of the present invention overcome the problems of conventional systems as will be desired in greater detail below.

SUMMARY OF THE EXEMPLARY EMBODIMENTS

In accordance with one exemplary embodiment a model 1911 semiautomatic pistol is provided. The pistol has a receiver, a barrel coupled to the receiver, a slide coupled to the receiver, and a firing mechanism coupled to the receiver. The firing mechanism is adapted for double action operation. The firing mechanism has a hammer with a firing pin strike surface and an engagement surface enabling single action operation of the firing mechanism. The engagement surface is moveable relative to the firing pin strike surface.

In accordance with another exemplary embodiment, a model 1911 semiautomatic pistol is provided. The pistol has a receiver, a barrel coupled to the receiver, a breach slide coupled to the receiver and a firing mechanism connected to the receiver. The firing mechanism has a trigger and a hammer both pivotally mounted to the receiver. The firing mechanism has a draw bar connected to the trigger and linking the trigger and the hammer so that the firing mechanism is capable of double action operation, and single action operation. The double action operation is full double action in that hammer cocking from its battery position to fully rotated position and release for firing is effected by the draw bar.

In accordance with yet another exemplary embodiment, a model 1911 pistol is provided. The pistol has a receiver, a barrel and a firing mechanism. The receiver has a model 1911 pistol trigger guard. The barrel is coupled to the receiver and the breach slide is moveably coupled to the receiver. The firing mechanism is connected to the receiver and has a hammer and a trigger moveably mounted to the receiver. The firing mechanism is a double action mechanism with the trigger pivotally mounted to the receiver with a user engagable portion disposed inside the trigger guard for user double action actuation of the firing mechanism. The firing mechanism has a draw bar linking the trigger and hammer and effecting double action actuation of the hammer. The draw bar is included within an outer wall of the receiver.

In accordance with still another exemplary embodiment, a pistol is provided. The pistol has a receiver, a barrel connected to the receiver, a breach slide moveable connected to the receiver and a firing mechanism moveable connected to the receiver. The firing mechanism has a hammer selectable from different interchangeable hammers. At least one of the interchangeable hammers has engagement features enabling double action only operation of the firing mechanism. Another hammer of the different interchangeable hammers has engagement features enabling both double action and single action operation of the firing mechanism.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
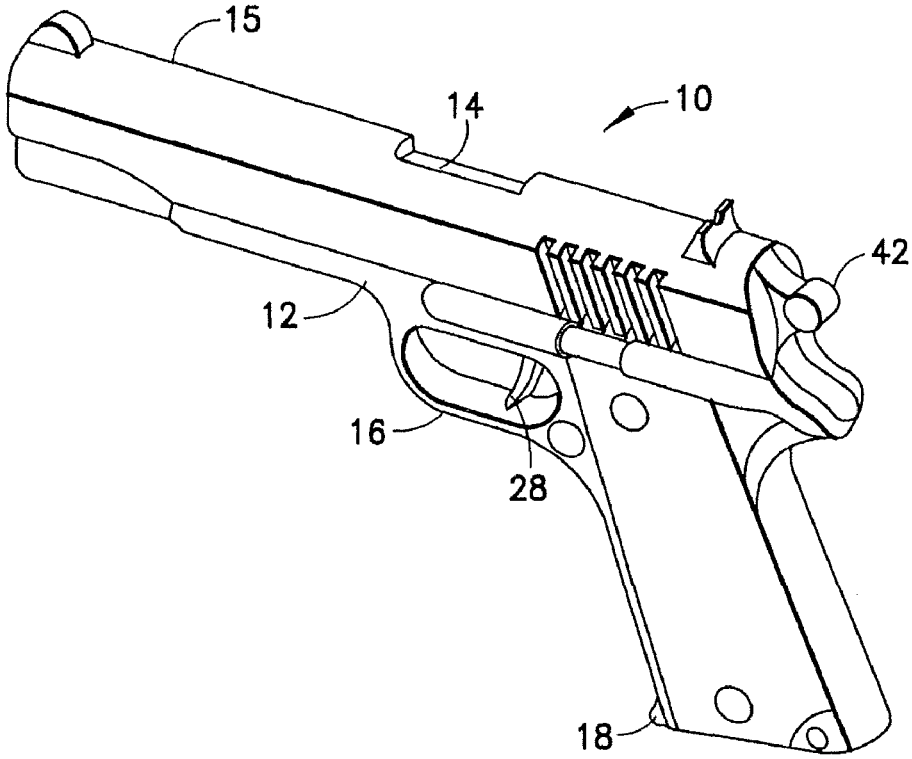
FIG. 1 is a left side isometric view of a pistol incorporating features in accordance with one exemplary embodiment of the present invention.

Referring to FIG. 1, there is shown an isometric view of a firearm 10 incorporating features of an exemplary embodiment. The firearm 10 is illustrated as a model 1911 pistol semi-automatic, though various features, as will be described further below, of the present invention are equally applicable to any suitable firearm. The pistol 10 has a receiver or frame 12, a barrel 14, a breach slide 15, a firing mechanism 16, and a removable cartridge magazine 18. Although the present invention will be described with the reference to the exemplary embodiments shown in the drawings, it should be understood that the present invention can be embodied in various different types and kinds of alternate embodiments and different types and kinds of firearms. In addition, any suitable size, shape or type of elements or materials could be used.

Figure 2:
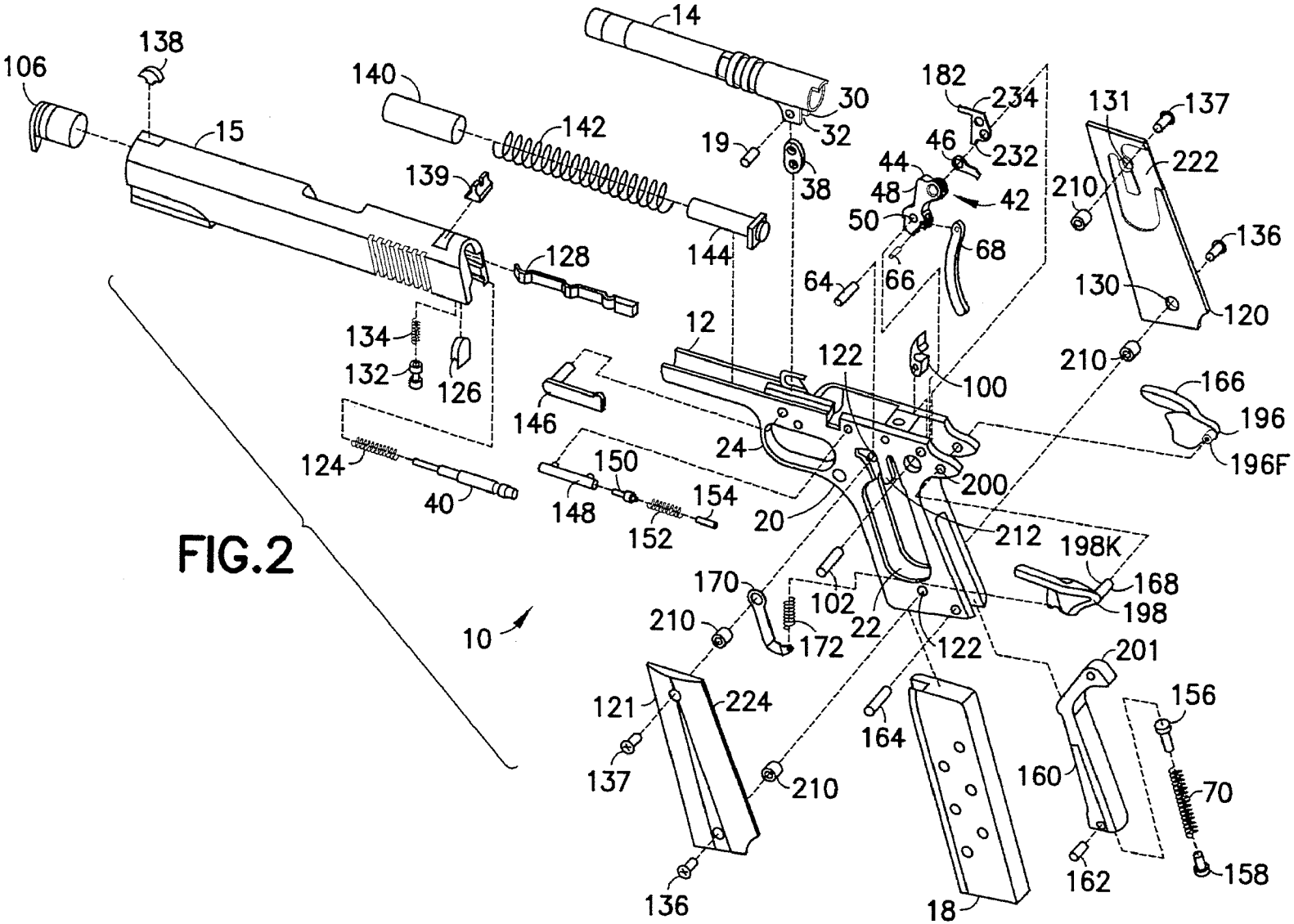
FIG. 2 is a partial exploded isometric view of the pistol shown in FIG. 1.
Figure 3:
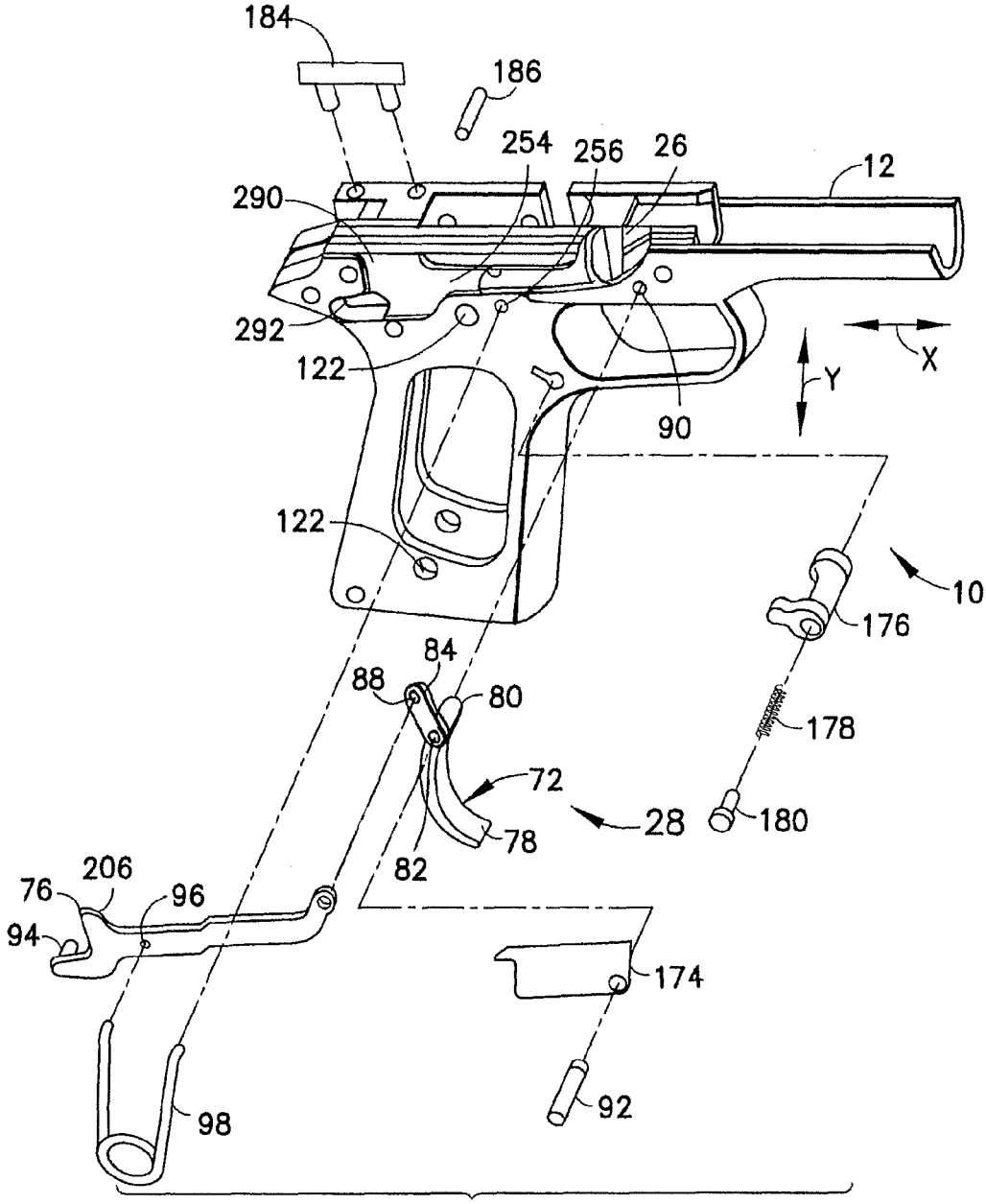
FIG. 3 is a right side partial exploded isometric view of the pistol shown in FIG. 1.

Referring also to FIGS. 2 and 3, a partial exploded isometric view of the pistol 10 is shown. As noted above pistol 10 in this embodiment is a model 1911 semi-automatic pistol, such as manufactured by Colt's Manufacturing Corp., and the components of the pistol are substantially the same as a model 1911 pistol except as otherwise described below. In this exemplary embodiment, pistol 10 is capable of both double action and single action operation as will be described below. The frame 12 may be preferably a one-piece member made of metal. However, the frame could be a multi-piece assembly including other materials such as plastic. The frame 12 has a stock or handgrip section 20 with a cartridge magazine receiving area 22, a trigger guard section 24 and a slot (not shown) for the trigger assembly. In the embodiment shown, the trigger assembly employs a pivoting trigger with an offset crank and engaging a draw bar. The trigger guard section 24 is sized and shaped substantially the same as that of a model 1911 pistol trigger guard. In this manner, the trigger guard 24 has the shape of a 1911 pistol while accommodating a trigger with sufficient throw to accommodate full double action and single action operation as will be described. The barrel 14 has a bottom rear lug 30. The lug 30 has a slot 32. A barrel link 38 connects the lug 30 to the frame 12 with a pin 19 and extends through the slot 32. The barrel link 38 causes the barrel 14 to move relative to the frame 12 under impetus from the breach slide. The slide 15 is slidingly mounted to the top of the frame 12. A main portion of the barrel 14 is located in a main channel of the slide 15 and guided by barrel bushing 106. The rear of the slide has a firing pin 40 therein preloaded by firing pin spring 124 against firing pin stop 126. An extractor 128 is also retained in the slide by firing pin stop 126 for ejection of spent cartridges. A firing pin plunger 132 and plunger spring 134 are provided to prevent the firing pin from advancing to the cartridge when the firing pin is improperly engaged. Plunger lever 182 is pivotally coupled to frame 12 with hammer pin 64. Except as otherwise described below, the firing pin 40, firing pin plunger 132, spring 134 and lever 182 are substantially similar to those disclosed in U.S. Pat. No. 4,555,861, incorporated by reference herein in its entirety. Plunger lever 182 has protrusions 232 and 234 that cooperate with the draw bar 76 in combination with trigger 28 to rise the firing pin plunger 132 and allow the firing pin to advance to the cartridge when the firing pin is properly engaged by hammer assembly 42. Front and rear sights 138, 139 are on slide 15. Recoil spring plug 140 is coupled to slide 15 housing recoil spring 142, the opposite end of which engages recoil spring guide 144 coupled to frame 12. The recoil spring 142 biases the slide forward relative to frame 12. Either manually or by firing action, when the slide 15 is moved rearward on the frame 12, the barrel 14 is moved rearward by the slide 15. As the barrel 14 is moved rearward, interaction between the barrel 14 and barrel link 38 causes the rear of the barrel to move downward. Slide stop 146 is pivotally mounted in frame 12. Plunger tube 148, slide stop plunger 150, plunger spring 152 and spiral pin 154 are mounted to frame 12. In alternate embodiments other types of barrels and/or barrel mounting systems could be provided. In alternate embodiments, any suitable type of slide could also be provided. In addition, any suitable type of firing pin or striker could be provided. Magazine catch 176, magazine catch and gate spring 178 and magazine catch lock 180 are provided coupled to frame 12 to retain and release the magazine 18. Ejector 184 and ejector pin 186 cooperate with extractor 218 to eject spent cartridges from firearm 10 after firing.

Figure 7A:
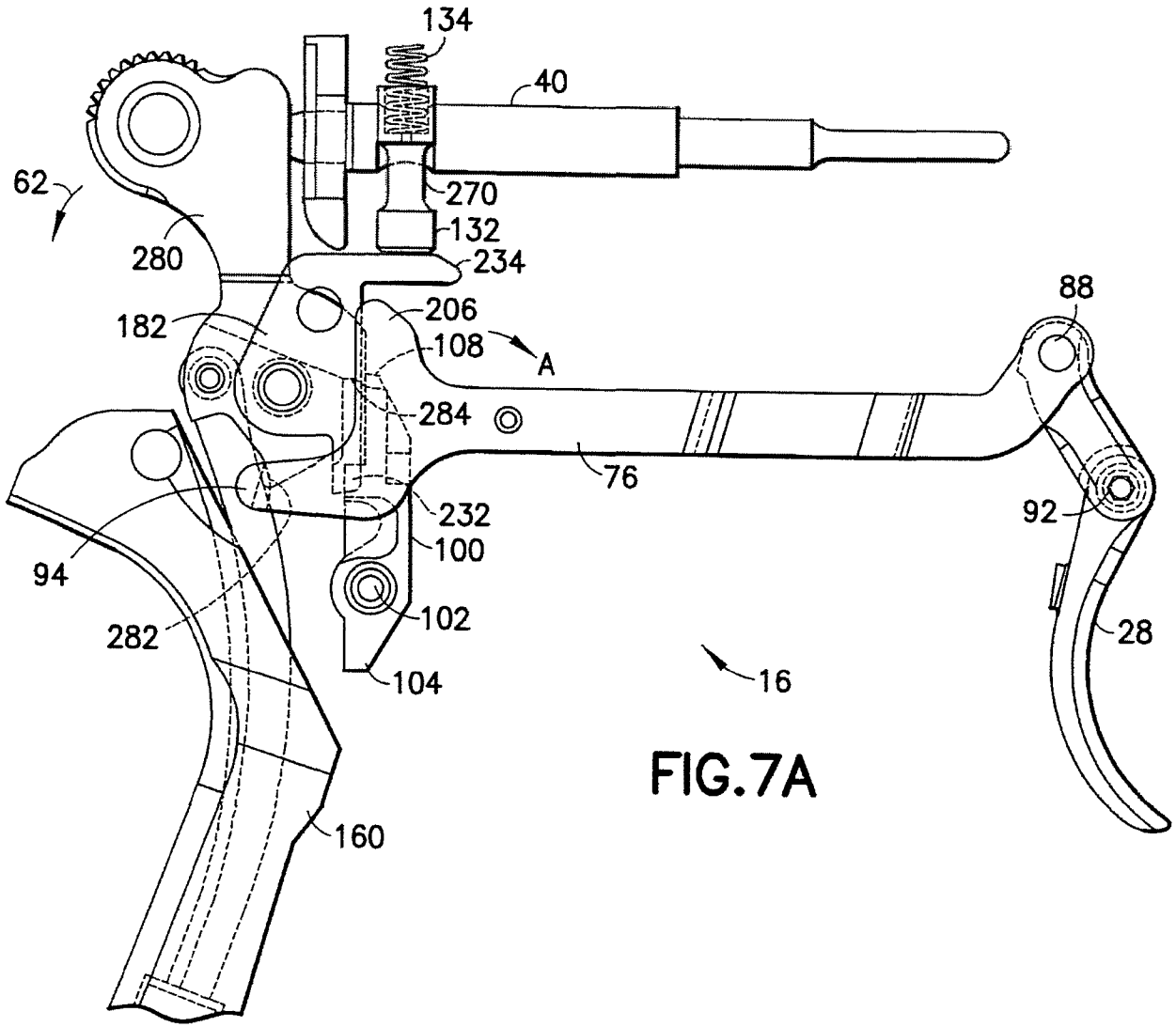
FIG. 7A is another partial right side view of the firing assembly in FIG. 6 with the firing assembly in a different position.
Figure 7B:
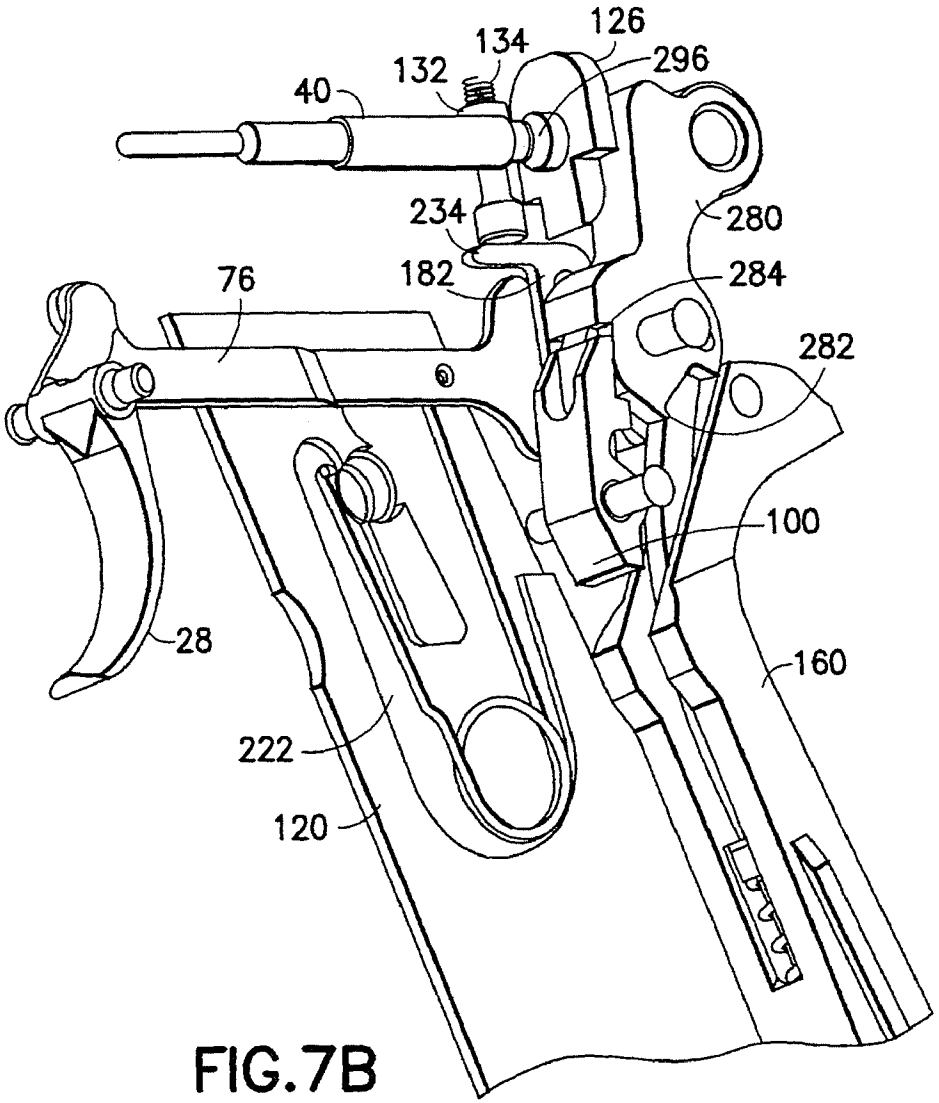
FIG. 7B is a partial left side isometric view of the firing assembly in the position shown in FIG. 6.
Figure 14A:
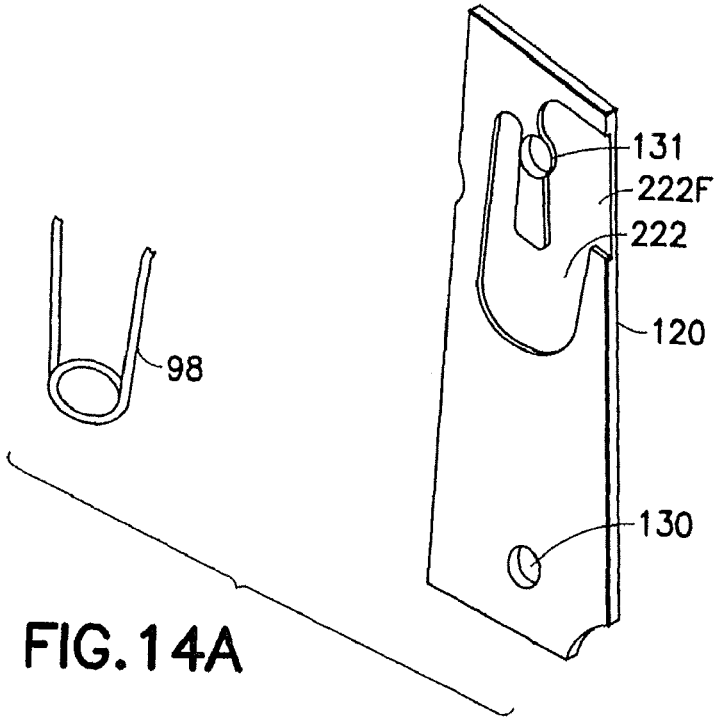
FIGS. 14A, 14B are exploded isometric views that respectively show the right and left grips and portions of the firing mechanism housed therein of the pistol in FIG. 1.
Figure 14B:
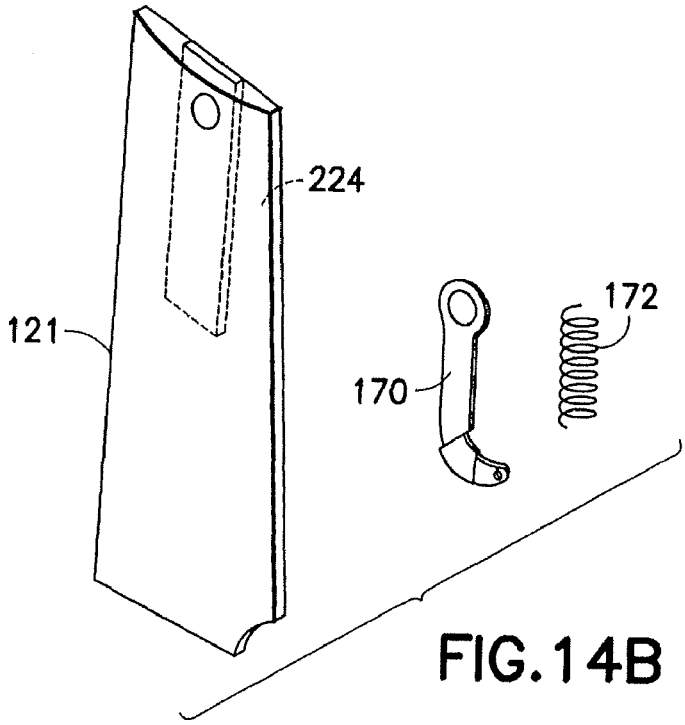

Referring also to FIGS. 7B, and 14A, 14B the handgrip section of the pistol 10 will be described. The pistol 10 includes two handgrip panels 120, 121 except as otherwise noted, the handgrip panels 120, 121 are substantially the same as model 1911 pistol handgrip panels. The panels 120 are mounted to the frame 12 on opposite sides of the handgrip section 20. In this embodiment, the handgrip section 20 has fastener holes 122 on each side. The holes 122 are located at top and the bottom of the handgrip section respectively. The right side panel 120 has matching holes 130, 131. Fasteners 136, 137 are inserted into holes 130, 131 and screwed into the bushings 210 where the bushings 210 are inserted into the holes 122 of frame 12. In alternate embodiments, the panels may be fastened to the handgrip section of the pistol frame using any other suitable means such as snap on detents.

Figure 4:
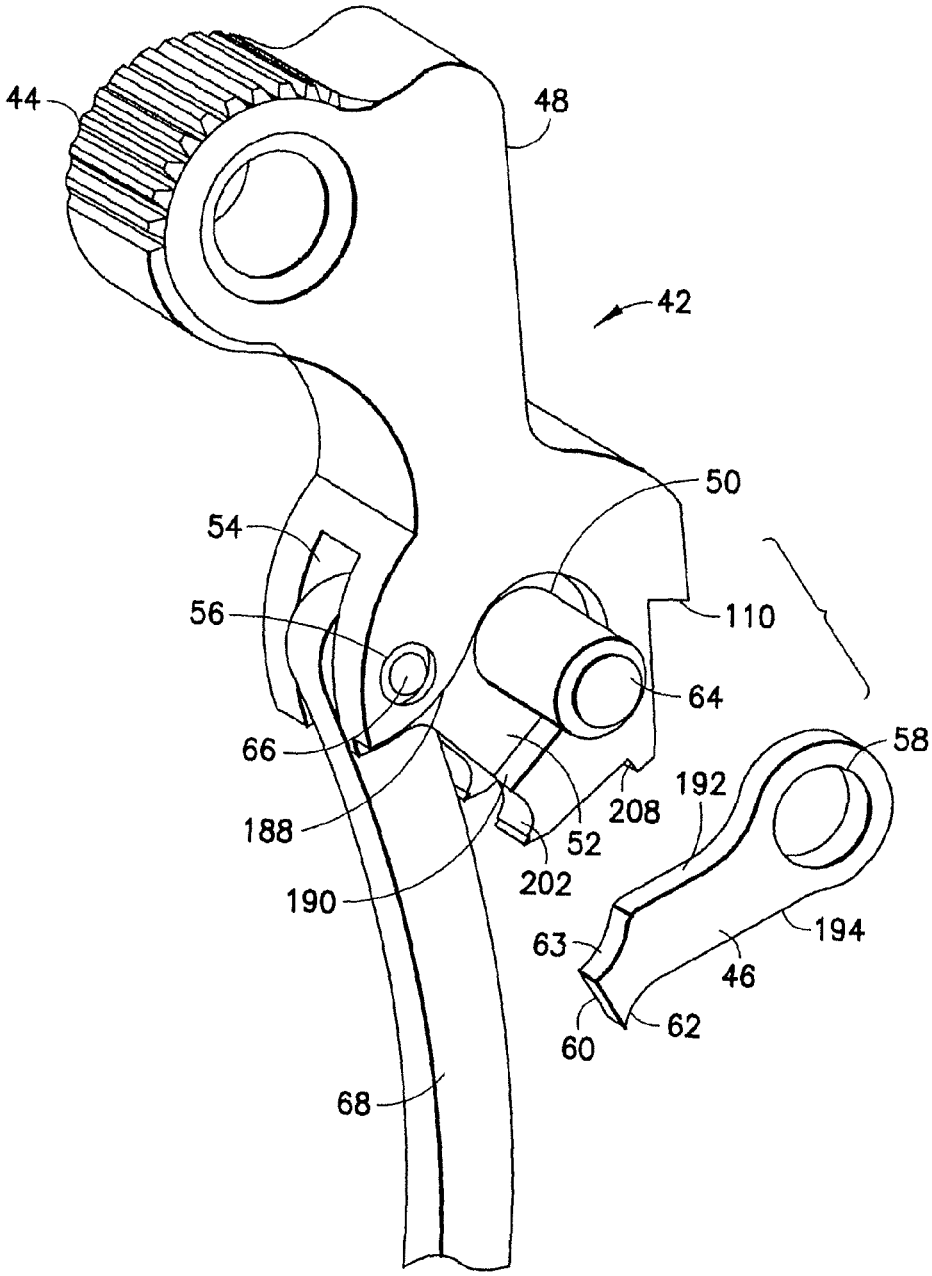
FIG. 4 is a partial isometric view of the rear of a hammer assembly for the pistol shown in FIG. 1.
Figure 5A:
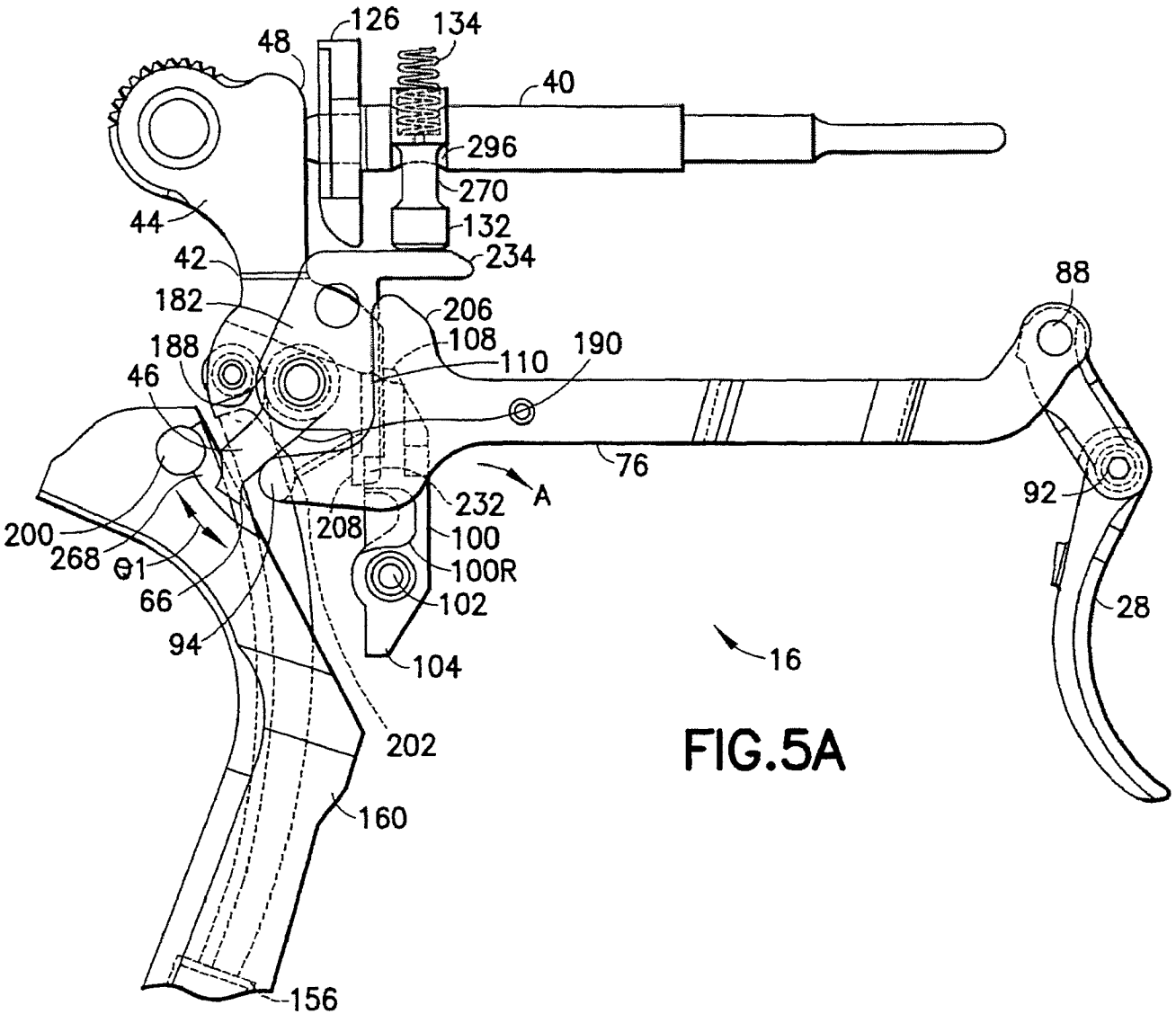
FIG. 5A is a partial right side view of a firing assembly for the pistol shown in FIG. 1.

Referring again to FIG. 2, firing mechanism 16 includes the trigger assembly 28, the draw bar 76, the firing pin 40 and a hammer assembly 42. Referring also to FIG. 4, the hammer assembly 42 includes a first hammer member 44 and a second hammer member 46 movably or pivotally mounted to the hammer. In this embodiment, the second hammer member has a general hook shape and is referred hereinafter as the hammer hook. In alternate embodiments, the second hammer member may have any other desired shape. The hammer hook 46 engages a hammer engagement end of the draw bar 76 to move the draw bar forward (and therefor the trigger) when the pistol is being fired in single action mode. The first hammer member 44 is made of metal, such as extruded, stamped or cast metal. In alternate embodiments, the first hammer member may be made of any suitable material. The first hammer member 44 has a striking face 48, a mounting hole 50, a rear slot 54, and two rear holes 56 (only one of which is shown in FIG. 4) on opposite sides of the rear slot 54. In this embodiment, the first hammer member has a recess or pocket 52 formed into a side of the first hammer member. The groove or pocket 52 is sized with stops 188, 190 for a predetermined gap between the hammer hook and the stops. The predetermined gap (also FIGS. 4A and 5A) allows the hammer hook 46 to travel relative to the first hammer member 44 in the direction indicated by arrow D1 in FIG. 5A. This relative travel between hammer hook and member 44 allows the hammer hook to clear the frame assembly, and in particular the posts 196, 198 (see FIG. 2) retaining the mainspring housing at the rear of the frame, during hammer rotation. The hammer hook 46 also moves to allow increased rotation of the hammer member 44 when released to strike the firing pin. The first hammer member has a first step surface 110. A second step surface 208 and draw bar catch or engagement surface 202 are also formed on the hammer member as shown in FIG. 4. The configuration of the steps and draw bar catch surfaces on the hammer member are merely exemplary, and in alternate embodiments the hammer member may have any other desired configuration. Side pocket 52 is shown in the right side of the hammer member 44, though in alternate embodiments, the pocket may be disposed in any other side of the first hammer member. The pocket is sized to admit the hook therein. The hammer hook 46 may be a plate made of metal or any other suitable material. The plate 46 may be stamped from a hardened metal member. The material for the hook may be different than the first hammer member. In this embodiment, the plate 46 has a mounting hole 58, sized for pin 64 and a bottom projection 60 with a surface 62 and scallop 63. Surface 62, as shown in FIG. 5A, is provided to engage draw bar 76 on cocking of hammer 44. Scallop 63 is provided to clear posts 196, 198 of the hammer release members upon firing. As seen best in FIG. 5A, a cutout or recess 268 within mainspring housing 160 is provided to allow hammer hook 46 freedom of movement relative to the main spring housing. The plate 46 may rotate within pocket 52 within a limited rotation angle until surface 192 of hook 46 engages stop surface 188 of hammer member 44 (for example, during cocking of the hammer 42), and/or surface 194 of hook member 46 engages stop surface 190 of hammer member 44 (for example during release or decocking of the hammer 42).

The shapes of the pocket 52 and the portion of the hook 46 in the pocket interlock the two members together. In alternate embodiments, any other suitable interlocking means may be used between the hammer member and draw bar engagement member of the hammer. The holes 50, 58 align with each other, and hammer pin 64 extends through the two holes 50, 58 to pivotably mount the hammer hook in the hammer member and the hammer assembly 42 to the frame 12. As will be described in greater detail below and seen best in FIG. 5A, the projection 60 extends out of the pocket 52 and past the bottom end of the first hammer member 44 so that the hammer hook 46 may engage the rearmost surface of the draw bar regardless of the vertical position of the rear end of the draw bar. When assembled, the right sides of the two members 44, 46 may be flush with each other. The interlocking nature of the two members allows the first hammer member 44 to rotate hammer hook 46 when the first hammer member is rotated about pin 64. In alternate embodiments other types of hammer assemblies could be provided. In addition, alternative or additional means could be provided to interlock the two hammer members together. As seen in FIG. 4, a strut pin 56 is mounted in the holes 56 and spans the rear slot 54. The hammer strut 68 extends into the slot 54. As seen in FIG. 2, the strut 68 is spring loaded by a spring 70 against the strut pin 66. The strut 68 engages spring 70 through mainspring cap 156. Spring 70 engages mainspring housing 160 through mainspring retainer pin 158 and roll pin 162. As may be realized the use of the hammer hook enables the double action mechanism to be fitted within the frame of the Model 1911 pistol.

Figure 5B:
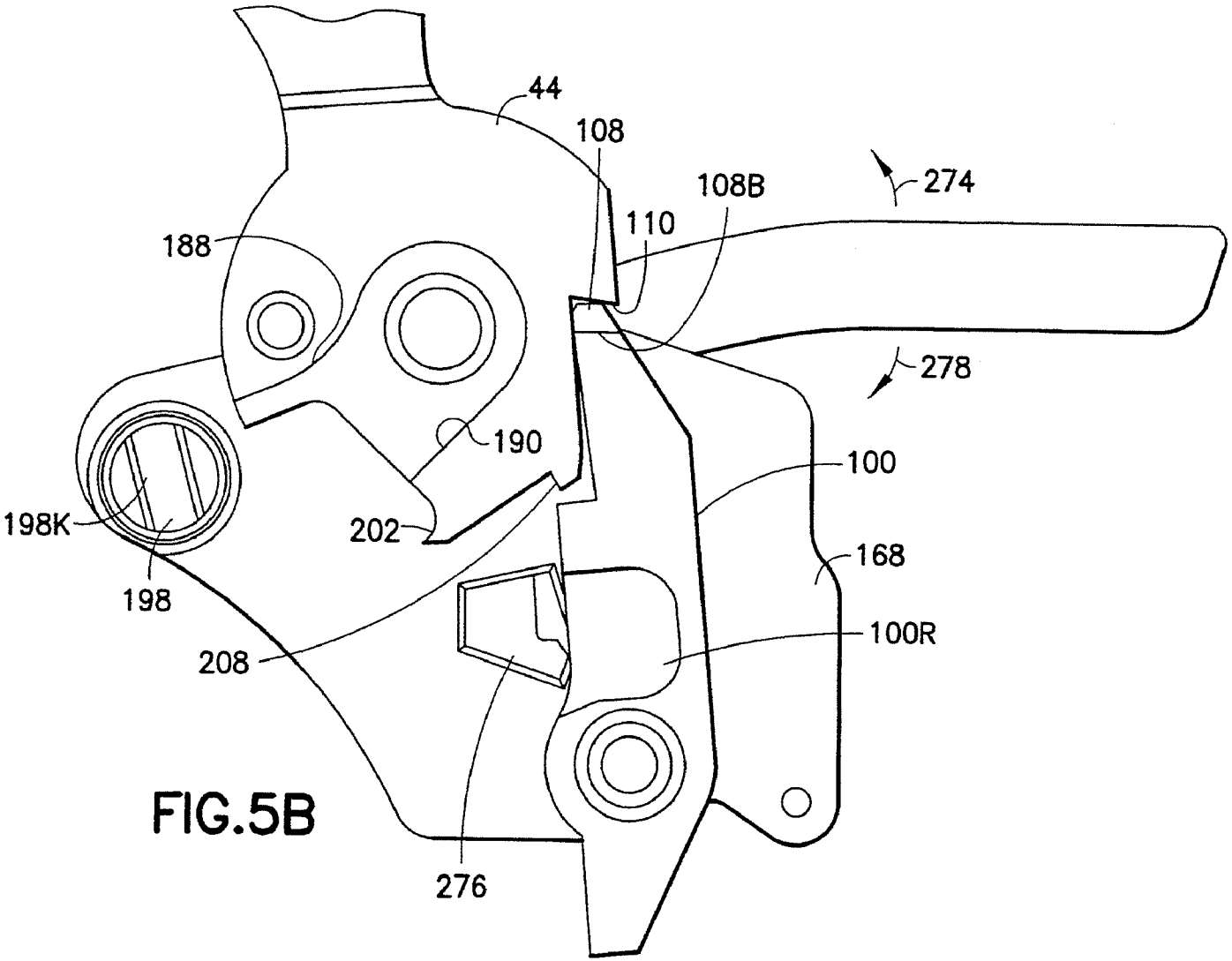
FIG. 5B is another partial right side view of the hammer, sear, and decock lever of the firing assembly shown in FIG. 5A.
Figure 12A:
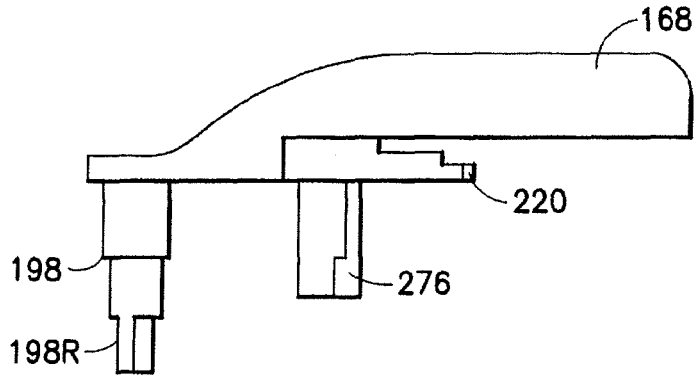
FIGS. 12A, 12B and 12C are top, right and front views respectively of the left decocking lever for the pistol shown in FIG. 1.
Figure 12B:
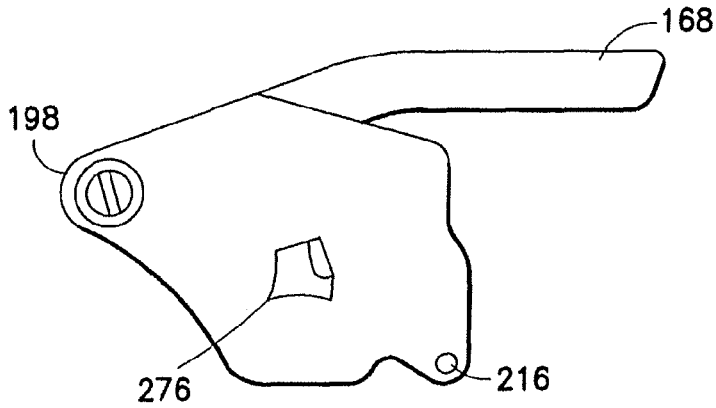
Figure 12C:
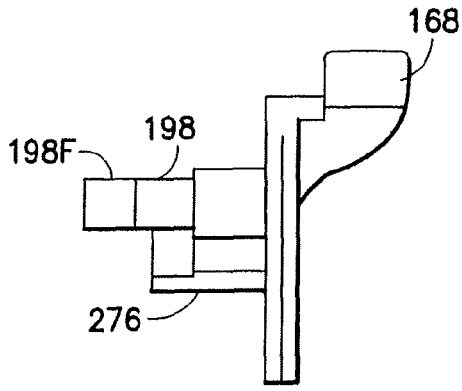
Figure 13A:
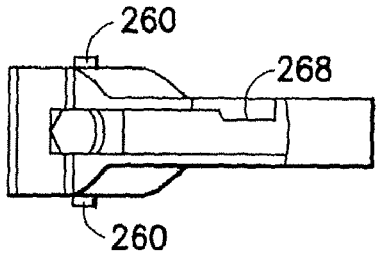
FIGS. 13A, 13B and 13C are top, left and rear views respectively of a mainspring housing for the pistol shown in FIG. 1.
Figure 13B:
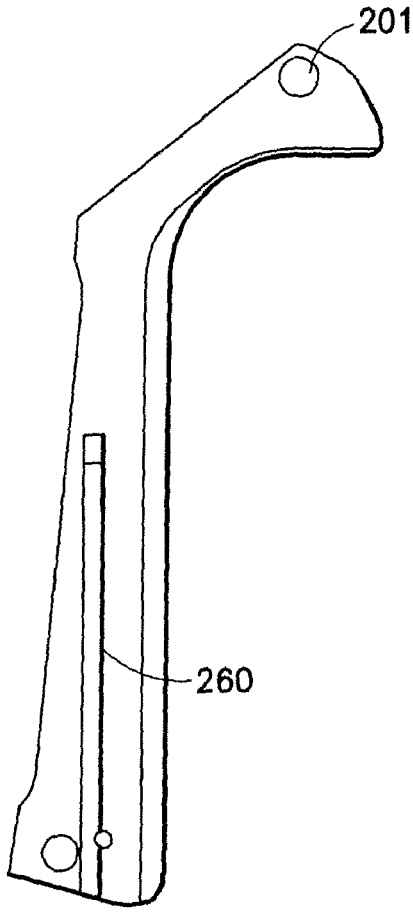
Figure 13C:
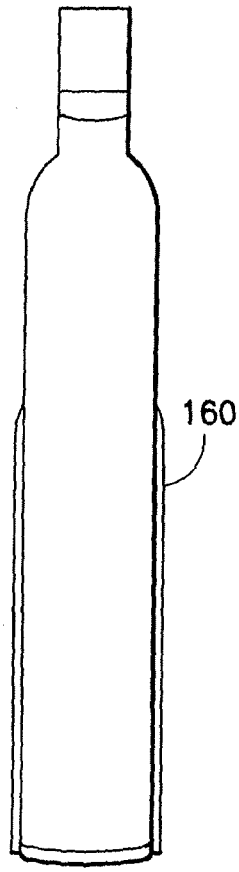

Referring also to FIGS. 13A, 13B and 13C are top, left and rear views respectively of mainspring housing 160. The mainspring housing 160 is coupled to receiver housing 12 via projections 260 in slots (not shown) and held by mainspring housing pin 164 (see FIG. 2). The combination of mainspring 70 and strut 68 biases the top of the hammer assembly 42 in a forward direction. In this embodiment, right and left decocking levers 166, 168 (see FIG. 2) are pivotally mounted by posts 196, 198 through bore 200 in receiver frame 12 and bore 201 in mainspring housing 160. In this embodiment, the decocking levers 166, 168 are interlocked thereby allowing decocking of the hammer 42 by operating either the left or right lever. For example, the respective posts 196, 198 may have keyed features 196K, 198K that interlock when assembled to the frame where the rotational motion of one is imparted to the other (see FIGS. 11A-11C, and 12A-12C). As seen also in FIG. 5B, decocking lever 168 has a sear engagement member 276 for engagement of the sear 100 when decocking the hammer as will be described in greater detail below. In alternate embodiments, any other suitable decocking lever may be used. In this embodiment, member 276 is disposed on lever 168, shown in FIGS. 12A-12C, for example purposes, and in alternate embodiments the decocking member may be disposed on any desired lever. Surfaces 218, 220 of decocking levers 166, 168 may be captured behind recesses 222, 224 of grips 120, 121 respectively capturing the levers after the grips are assembled to the frame 12. The end portion (only end portion 222E of recess 222 is shown in FIG. 14A, the end portion of recess 224 may be similar but opposite hand) of recesses 222, 224 form a clearance with surface 218, 220 of the decocking levers allowing the levers to move freely relative to the hand grip panels. Thus mounted, the levers 196, 198 may be rotated relative to the frame about posts 196, 198 between a down position (shown in FIG. 4) and an up or decocking position (not shown.

Figure 10A:
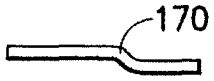
FIGS. 10A, 10B and 10C are top, left and rear views respectively of a bracket for the pistol shown in FIG. 1.
Figure 10B:
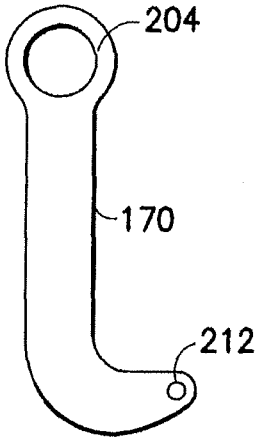
Figure 10C:
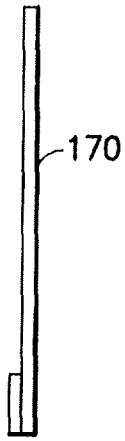
Figure 11A:
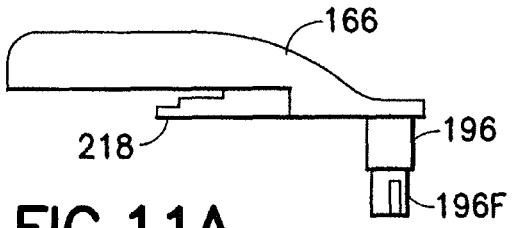
FIGS. 11A, 11B and 11C are top, left and rear views respectively of the right decocking lever for the pistol shown in FIG. 1.
Figure 11C:
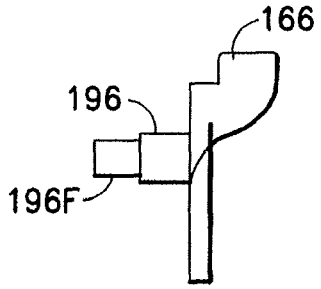
Figure 11B:
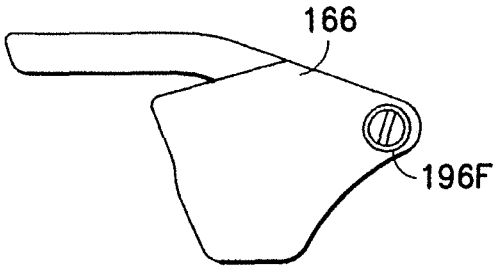

The decocking levers are biased in the down position by spring 172 (see FIGS. 2 and 14B). Referring also to FIGS. 10A-10C, decocking lever spring bracket 170, in this embodiment the bracket is shown having general "J" shape for example purposes and in alternate embodiments the bracket may have any desired shape or may be replaced by a hole machined into the receiver frame. J-bar 170 is coupled to frame 12 by bushing 210 through hole 204 and 122 of frame 12. J-bar 170 may be disposed into and constrained not to rotate within frame 12 by groove or slot 212 in frame 12 (see FIG. 2). Hole 214 in J-bar 170 supports one end of decocking lever spring 172, the other end of which engages the left decocking lever 168 at hole 216 to bias right and left decocking levers 166, 168 down in the disengaged position. The right and left decocking levers 166, 168 are provided to release a cocked hammer (e.g. hammer is in position with stop 208 engaging sear 100) without firing the weapon. In alternate embodiments other types of decocking assemblies could be provided. In this embodiment, the bar 170 and spring 172 may be housed at least partially within recess 224 of grip 121 (see FIG. 14B).

Figure 8A:
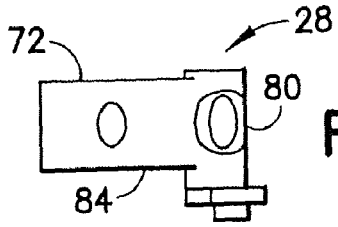
FIGS. 8A, 8B and 8C are top, right and front views respectively of the trigger for the pistol shown in FIG. 1.
Figure 8B:
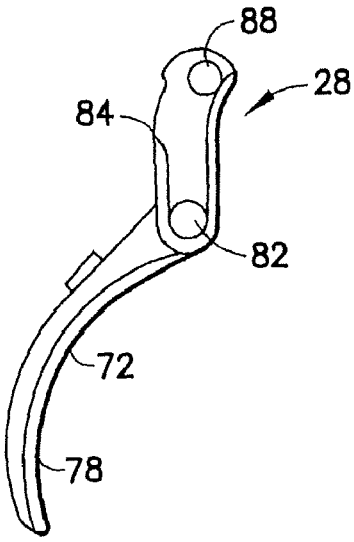
Figure 8C:
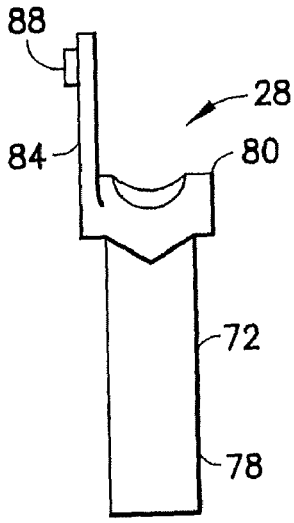

Referring also to FIG. 3, a partial exploded isometric view of the pistol 10 is shown. Referring also to FIGS. 8A, 8B and 8C, are top, right and front views respectively of trigger assembly 28. The trigger assembly 28 generally comprises a trigger member 72 and a draw bar 76. The trigger has a pivotal mount with an offset crank and fits within the trigger guard of the model 1911 pistol receiver. The pivotal mount of the trigger is positioned to allow sufficient motion within the trigger guard for full double action operation (i.e. rotating the hammer member 44 from its battery position, against the slide when the slide is in firing ready position, see FIG. 5A, to the fully rotated position (i.e. maximum rotation of hammer, and disengagement of sear 100 from hammer). The trigger member 72 is shown as a one piece member for example purposes. The trigger member 72 has a bottom finger contact section 78, a middle section with a pocket 80 and a mounting hole 82, and a top section 84 with a side projection 88. The top section 84 and side projection 88 define the offset crank of the trigger. The width of the finger contact section 78 is about the same width of the slot 26 in the frame 12. A trigger pin 92 extends through the holes 82, 90 and also retains side plate 174 covering draw bar 76. The pin 92 is connected to the frame 12 across the slot 26 (not shown) through hole 90. This pivotably mounts the trigger member 72 to the frame 12. The top section 84 is relatively thin and extends from only this right side of the trigger member 72.

Figure 9A:
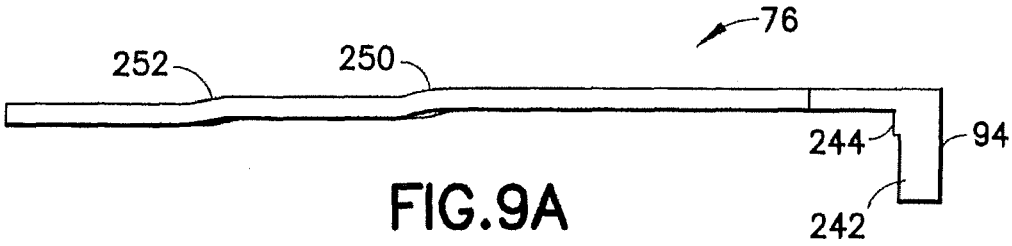
FIGS. 9A, 9B and 9C are top, left and rear views respectively of the draw bar for the pistol shown in FIG. 1.
Figure 9B:
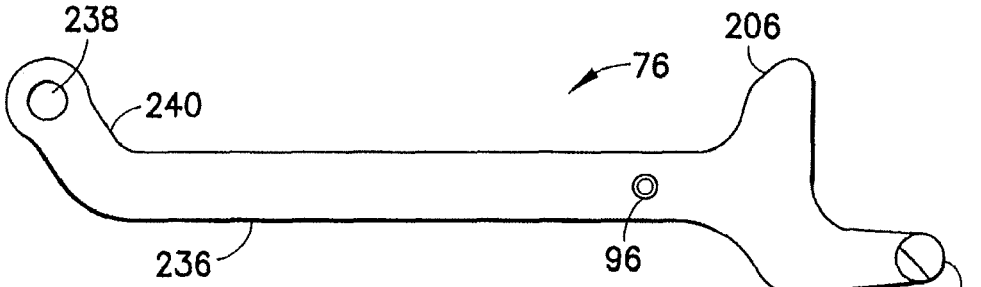
Figure 9C:
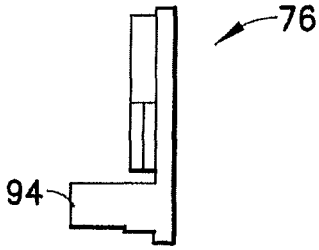

Referring also to FIGS. 9A, 9B and 9C which respectively are top, left and rear views of the draw bar 76. In this embodiment, draw bar 76 allows both double action and single action operation of firearm 10. Draw bar 76 may have a thin profile that allows mounting in a groove 254 (see FIG. 3) formed into outer wall surface of the receiver frame 12. Draw bar 76 as a result, does not extend through interior of receiver frame. The draw bar in the exemplary embodiment is offset from the barrel and located on one side of the barrel. The draw bar is included within the receiver frame of the model 1911 pistol. In this embodiment, the draw bar groove or channel 254 is formed into the outer side of the receiver frame 12 and has access opening 290 allowing raised cam 206 on the draw bar to contact and engage slide rail 15. In alternate embodiments, the draw bar channel or recess may be formed in an inside surface of the receiver frame. The frame 12 has cutout 292 to allow engagement finger 94 on draw bar 76 to extend through the receiver and respectively engage the hammer, for hammer cocking action, and engage the sear 100 for firing as compared to a conventional 1911 that has no cutout. The trigger draw bar 76 has a longitudinal portion with a front end 236 with hole 238 that is pivotably mounted on the side projection 84 (see FIG. 3). As seen best in FIG. 9B, front end 236 has offset portion 240 allowing draw bar 76 to be joined to trigger side projection 84, and allow for travel of the trigger and draw bar without interference with barrel link 38 or the link pin. This end joined to the trigger has an upward bend allowing a connection to the trigger without interference with the pin for barrel pivoting where the location also increases mechanical advantage for easier trigger pull during double action operation. In the exemplary embodiment, the width of the front end of the draw bar 76 may be about the same width as the side projection 88 though in alternate embodiments draw bar 76 may have any desired shape. The rear end of the bar 76 may have an inwardly extending lateral projection 94 and a hole 96. The inwardly extending projection 94 has an inner portion 242 and outer portion 244 that have a step between them with a different shape as shown. As may be realized from FIG. 5A, the inner portion 242 engages surface 202 of hammer member 44, surface 66 of hammer hook 46, the sear 100 and protrusion 232 of plunger lever 181. The outer portion 244 is a span section and may have any desired shape. As seen best in FIG. 9A, draw bar 76 formed steps 250, 252 allowing the draw bar to clear magazine 18 during operation.

The channel 254 formed on the outside of receiver frame 12 to accept draw bar 76 is sized to allow draw bar motion in both directions indicated by X and Y arrows in FIG. 3, while draw bar 76 is operable offset laterally form the barrel 14 centerline. The channel may be formed by any suitable means. In alternate embodiments, the channel may be formed within interior surfaces of the frame eliminating use of covers 174. The combination of grip 120 and cover 174 prevent exposure of the firing mechanism 16 and the draw bar 76 to the outside of firearm 10. As may be realized use of cover 174 allows access for machining the channel in the receiver and access for assembly of the firing mechanism. A cammed profile 206 is provided to cooperate with slide 15 for positioning the draw bar relative to the hammer, plunger lever and seal for proper operation of the firing mechanism. The raised cam section 206 may project through opening 290 to contact and act against bottom of slide rail for double action and single action position as will be described below. A spring 98 is provided with one end connected to the frame 12 at hole 256 and an opposite end connected to the draw bar 76 at the hole 96. The spring 98 biases the draw bar 76 in a rearward and up direction. This maintains contact between the draw bar and hammer hook 46 at the rear of the draw bar and between the draw bar and bottom of breach slide 15. The spring is seated within recess 222 of grip 120 (see FIGS. 7B and 14A). The recess 222 is sufficient in size to accommodate freedom of movement of the spring while still having a surface to allow the grip to be fastened flush to frame 12. The grips are provided in combination with frame 12 and formed to define a housing with the shape of a model 1911 pistol. The draw bar spring 98 extends through the inner surface of the grip to be admitted into a groove in receiver frame 12 as a draw bar spring slot. The rear projection 94, when the draw bar 76 is pulled forward is positioned to contact the engagement surface 202 of hammer 44 and pivot the hammer assembly 42 about the hammer pin 64 to cock the hammer.

FIG. 5A shows the bar 76 pulled forward to a point where the projection 94 is engaged with hammer member 44. Sear 100 is pivotably mounted to the frame 12 by a sear pin 102. The bottom end 104 of the sear 100 is biased forward by a sear spring (not shown). The top end 108 of the sear 100 is located to engage a stop surface 110 on the hammer assembly 42 when the hammer member is sitting on the safety shelf 108 of the sear 100 in the battery position (sear 100 is shown in FIG. 5A slightly forward of the position when the hammer is at battery, see also FIG. 5B). When the draw bar 76 is pulled forward for example by a user moving the trigger assembly 28, the projection 94 of draw bar 76 is moved forward. The projection 94 contacts the catch surface 202 of hammer member 44 and causes the hammer assembly 42 to rotate. If the trigger assembly 28 is released by the user before the projection 94 is pulled off of the surface 202 in a forward direction, the hammer assembly 42 is returned to the battery position, shown in FIG. 5B, where the end 108 of the sear 100 contacts the stop surface 110 of hammer member 44 to stop the striking surface 48 from striking the rear end of the firing pin 40. As the trigger assembly 28 is moved by a user through a full pull or stroke, hammer rotation causes second stop surface 208 to move past sear surface 108B, that is disposed to engage stop surface 208 on the hammer when in the cocked position. Before the draw bar projection 94 is pulled off of the surface 202, the draw bar projection 94 contacts the lower projection 232 of plunger lever 182 moving plunger 132 up and the draw bar projection 94 contacts the end surface of the sear 100 thereby moving the sear forward. This causes the sear 100 to rotate, as indicated by arrow A in FIG. 5A, moving the top end 108 of the sear 100 out of the path of the stop surface 110 and 208. As the draw bar 76 comes into the contact with the sear, the draw bar remains engaged with hammer surface 202 positioning the hammer member 44 in its fully rotated position. In this position, clearance may exist between second stop surface 208 and second sear surface 108B allowing smooth motion of the sear in direction A to clear the hammer stop surfaces. Thus, when the projection 94 is pulled off of the surface 202, the hammer assembly 42 can pivot forward to strike the rear end of the firing pin 40 without the sear 100 stopping the full motion of the hammer assembly and where the firing pin 40 is free to strike a cartridge as depression or recess 270 in plunger 132 aligns with firing pin 40 allowing it to pass. Otherwise, if the trigger is not pulled back sufficiently the plunger 132 blocks recess 296 in pin 40. After the pistol 10 is fired, the slide 15 moves rearward and engages cammed end 206 of draw bar 76 camming the draw bar down to a position where projection 94 is aligned with recess 100R in sear 100. The sear 100, biased to battery position (shown in FIG. 5B) cams the draw bar projection 94 into the recess, thereby allowing the sear 100 to return back to its biased position shown in FIG. 5B. As the slide 15 returns to its battery position, the surface 108B of the sear 100 engages the hammer assembly 42 at the cocked stop surface 208. Thus, the hammer assembly 42 remains cocked and is prevented from striking the firing pin 40 a second time. Additionally, the surface 66 of hammer hook 46 engages with the rear surface of projection 94 of draw bar 76 and guides the draw bar biased by the draw bar spring upwards so that projection 94 is aligned with and is capable of engaging the surface 202 of hammer member 44 such that pulling on trigger assembly 28 fires the weapon in a single action mode (as the hammer 44 is now in the cocked position). As an alternative to firing an initial shot with the hammer in the position shown in FIG. 5A, the user may first cock the hammer assembly 42 by pulling on hammer 44 (or operating the slide) until the surface 108B of the sear 100 catches the hammer assembly 42 at the cocked stop surface 208. Here, the hammer assembly 42 remains cocked and is prevented from striking the firing pin 40. As before, the surface 66 of hammer hook 46 engages with the rear surface of projection 94 of draw bar 76 and cooperates with the surface 202 of hammer member 44 such that pulling on trigger assembly 28 fires the weapon in a single action mode as the hammer 44 is in the cocked position. If the user wishes to decock the hammer without firing either after an initial shot or after cocking the hammer as previously described the user may use the left or right decock levers 166, 168. Here, the decock lever 168 is raised in direction 274 and lowers from spring load in direction 278 with decock protrusion 276 releasing the sear and catching the hammer.

Figure 6:
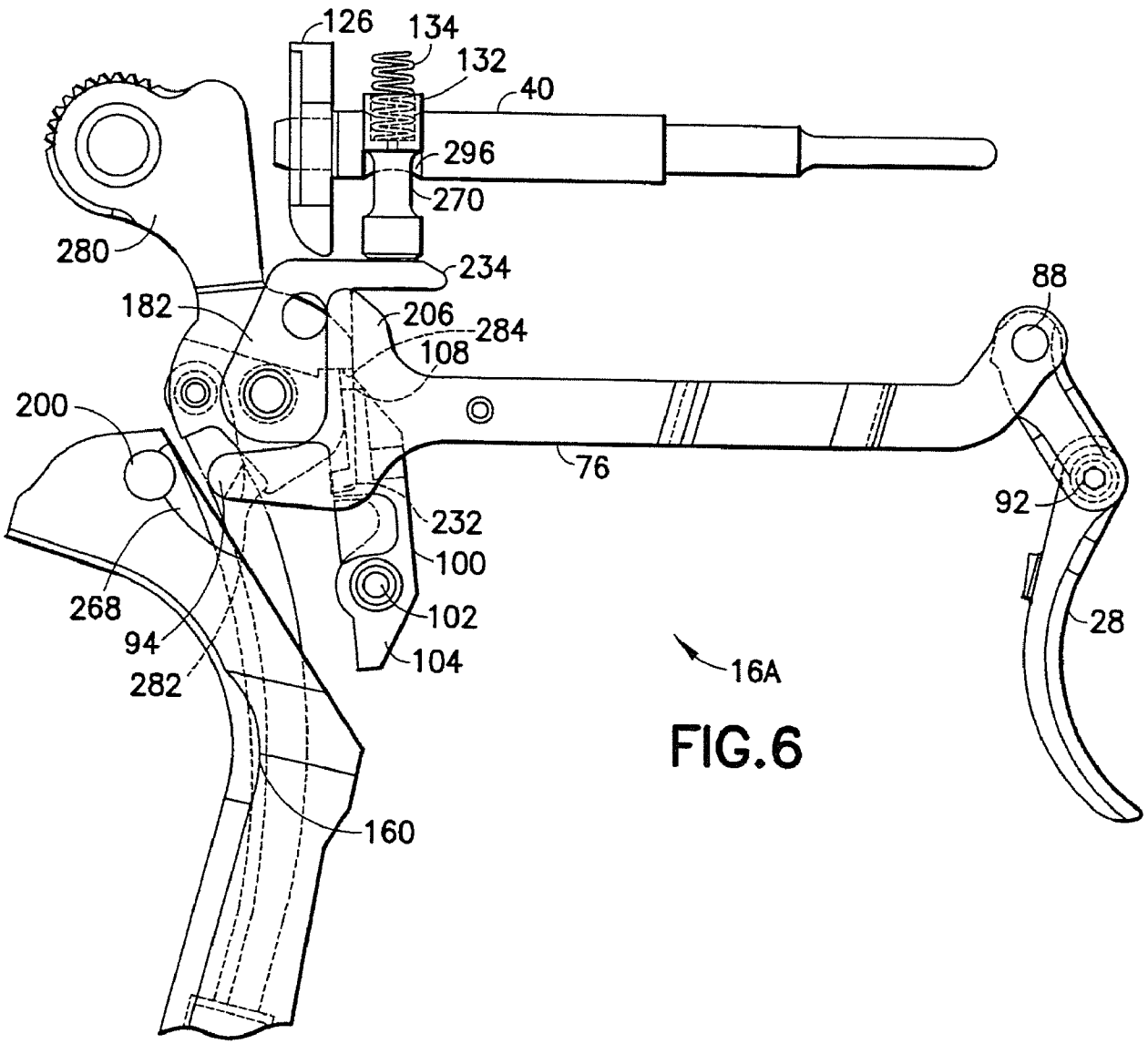
FIG. 6 is a partial right side view of a firing assembly for the pistol shown in FIG. 1 in accordance with another exemplary embodiment.
Figure 7C:
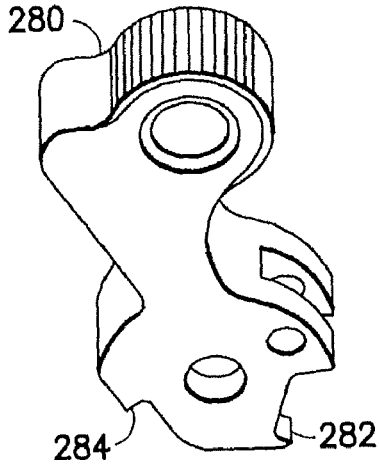
FIG. 7C is an isometric view of the hammer of the firing assembly shown in FIG. 6.

Referring now to FIG. 6, there is shown a firing mechanism for a model 1911 pistol similar to pistol 10 adapted for a double action only operation in accordance with another exemplary embodiment. Except as otherwise noted, the firing mechanism 16A in this embodiment is substantially similar to firing mechanism 16 described before. Firing mechanism 16A has a hammer assembly 280 that is interchangeable with hammer assembly 42. Thus, firing mechanism 16A in this exemplary embodiment may be converted to firing mechanism 16, or vice versa, by substitution of hammer assembly 280 with hammer assembly 42. Hammer assembly 280, in this embodiment allows only double action operation of the firing mechanism. In other words, in a double action only configuration, the hammer assembly 280 cannot be locked in a cocked position and firing may only be effected via the trigger. In this embodiment, left and right decocking levers may not be provided, with associated elimination of the supporting "J"-bar and decocking lever biasing spring. The hand grips, similar to grips 120, 121 may be modified in that case to extend and cover the area where the decocking levers were located. In this embodiment, the hammer assembly 280 may not have a second hammer member similar to hammer hook 440. In this embodiment, the cocked hammer sear step (similar to stop surface 208) on the hammer may also not be provided (replaced in the exemplary embodiment shown in FIG. 7C with a smooth surface). Alternately, components such as the j-bar, de-cock lever, and the hammer hook may simply be left on the firearm and the hammer replaced for the conversion from double/single to double only action. By leaving the features in firearm 10 to accept the double/single action components, or double action only components that are interchangeable, the result is a model 1911 semi-automatic pistol that may be readily switched from double/single action to double only action and vice versa by swapping hammer assemblies. Referring still to FIG. 6, the firing mechanism 16A is shown in the battery position with the trigger 28 relaxed. Referring also to FIG. 7A, bar 76 is pulled forward to a point where the projection 94 is engaged with hammer 280. As noted before, sear 100 is pivotably mounted to the frame 12 by a sear pin 102. The bottom end 104 of the sear 100 is biased forward. The top end 108 of the sear 100 is located to engage a stop surface 284 on the hammer 280 when the trigger member is in the battery position slightly behind the position shown in FIG. 6. When the draw bar 76 is pulled forward by a user moving the trigger assembly 28, the projection 94 of draw bar 76 is moved forward as shown in FIG. 7A. The projection 94 contacts the catch surface 282 of hammer 280 and causes the hammer 280 to rotate in direction C2. If the trigger assembly 28 is released by the user before the projection 94 is pulled off of the surface 282 in a forward direction, the hammer assembly 280 is returned to the battery position shown in FIG. 6 where the end 108 of the sear 100 contacts the stop surface 284 of hammer 280 to stop the striking surface (similar to surface 48) from hitting the rear end of the firing pin 40. If the trigger assembly 28 is moved by a user through a full pull or stroke, before the projection 94 is pulled off of the surface 282, the draw bar projection 94 contacts the lower projection 232 of plunger lever 182 moving plunger 132 up and the draw bar projection 94 contacts the rear of the sear 100 and moves it forward. This causes the sear 100 to rotate as indicated by arrow A (see FIG. 7A) moving the top end 108 of the sear 100 out of the path of the stop surface 284. Thus, when the projection 94 is pulled off of the surface 282, the hammer 280 can pivot forward to strike the rear end of the firing pin 40 without the sear 100 stopping the full motion of the hammer and where the firing pin 40 is free to strike a cartridge as depression or recess 270 in plunger 132 aligns with pin 40 allowing it to pass. After the pistol 10 is fired, the slide 15 moves rearward and engages cammed end 206 of draw bar 76 to cam draw bar down and allow the sear 100 to return back to its biased position shown in FIG. 6. As the slide 15 returns to its battery position, the top surface 108 of the sear 100 catches the hammer assembly 280 at the surface 284. Thus, the hammer assembly 280 is prevented from striking the firing pin 40 a second time. If the user tries to cock the hammer assembly 280, the hammer will rotate but return to the battery position shown in FIG. 6 when released and will not remain cocked. In this manner, pulling on trigger assembly 28 fires the weapon in a double action only mode. Pistol 10 is a true double action pistol, whether in the double action only or in double/single action form, that allows multiple strikes at the cartridge in the event of misfire by pulling the trigger only (i.e. without having rack the slide or cock the hammer by hand.)

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A model 1911 semi automatic pistol, comprising;

a receiver;

a barrel coupled to the receiver;

a breach slide coupled to the receiver; and a firing mechanism coupled to the receiver;

wherein, the firing mechanism is adapted for double action operation, and wherein the firing mechanism has a hammer with a firing pin strike surface and an engagement surface enabling single action operation of the firing mechanism, the engagement surface being movable relative to the firing pin strike surface in response to motion of the hammer.

2. The pistol of claim 1 wherein the firing mechanism comprises a trigger, and a draw bar; the trigger and hammer each being pivotally mounted to the receiver; wherein, the draw bar links the trigger and hammer to effect double action and single action operation of the firing mechanism.

3. The pistol of claim 2 wherein the trigger is of unitary construction and has an offset crank coupled to the draw bar.

4. The pistol of claim 2 wherein the draw bar comprises a cam; and wherein the cam cooperates with the breach slide for switching from double action to single action operation of the firing mechanism.

5. The pistol of claim 1 wherein the receiver has a model 1911 pistol trigger guard, and the firing mechanism has a trigger pivotally mounted to the receiver with a user engagement portion disposed within the trigger guard.

6. The pistol of claim 1 wherein the hammer comprises a first hammer member having a hammer head with the firing pin strike surface thereon and a second hammer member movably mounted to the first hammer member and moving the engagement surface thereon.

7. The pistol of claim 6, wherein the firing mechanism has a hammer draw bar for cocking the hammer and wherein the second hammer member passes the draw bar for single action operation of the firing mechanism.

8. The pistol of claim 6 further comprising a hammer strut pivotally connected to the hammer, a mainspring housing connected to the receiver, and a mainspring engaged with both the hammer strut and the mainspring housing, wherein, the mainspring pre loads the hammer for firing and wherein the mainspring housing has a recess formed therein allowing the hammer to travel therein during firing of the firearm.

9. The pistol of claim 8, wherein a portion of the second hammer member is located in the recess.

10. A model 1911 pistol comprising:

a receiver;

a barrel coupled to the receiver;

a breach slide coupled to the receiver; and a firing mechanism connected to the receiver;

the firing mechanism having a trigger and a hammer both pivotally mounted to the receiver, the firing mechanism having a draw bar connected to the trigger and linking the trigger and the hammer so that the firing mechanism is capable of double action operation, and single action operation, the double action operation being full double action wherein hammer cocking from its battery position to fully rotated position and release for firing is effected by the draw bar, wherein the hammer has a first hammer member with a striking face and a second hammer member movably mounted to the first hammer member, and wherein the second hammer member has a draw bar engagement surface engaging the draw bar during single action operation.

11. The pistol of claim 10 wherein the second hammer member moves the draw bar and the trigger from a double action to a single action operating position.

12. The pistol of claim 10 wherein the first hammer member has an inset sized to accept the second hammer member therein.

13. The pistol of claim 12 wherein the inset comprises a groove having stops engaging the second hammer member, the movement of the second hammer member within the stops establishing a predetermined range of motion between the second hammer member and the first hammer member.

14. The semi automatic firearm of claim 10 wherein the second hammer member engages a hammer engagement end of the draw bar to move the draw bar forward relative to the receiver during single action operation of the firing mechanism, and wherein the trigger is pre positioned during a hammer cocking by the breach slide to a location where a pull of the trigger immediately releases a sear for firing of the firearm.

15. The semi automatic firearm of claim 10 wherein the second hammer member is capable of travel relative to the first hammer member, the travel of the second hammer member defining an increased travel distance of the first hammer member relative to the second hammer member when the hammer is released from its cocked position and pistol is fired.

* * * * *